US012116702B2

(12) United States Patent
Zhou et al.

(10) Patent No.: US 12,116,702 B2
(45) Date of Patent: Oct. 15, 2024

(54) ULTRA-HIGH MOLECULAR WEIGHT POLYETHYLENE FIBER WITH ULTRA-HIGH CUT RESISTANCE AND PREPARATION METHOD THEREOF

(71) Applicant: XINGYU SAFETY PROTECTION TECHNOLOGY CO., LTD, Weifang (CN)

(72) Inventors: Xingyu Zhou, Weifang (CN); Haitao Zhou, Weifang (CN); Hongbo Zhou, Weifang (CN); Yong Zhao, Weifang (CN)

(73) Assignee: XINGYU SAFETY PROTECTION TECHNOLOGY CO., LTD, Weifang (CN)

( * ) Notice: Subject to any disclaimer, the term of this patent is extended or adjusted under 35 U.S.C. 154(b) by 570 days.

(21) Appl. No.: 16/639,752

(22) PCT Filed: Sep. 11, 2019

(86) PCT No.: PCT/CN2019/105436
§ 371 (c)(1),
(2) Date: Feb. 18, 2020

(87) PCT Pub. No.: WO2021/007943
PCT Pub. Date: Jan. 21, 2021

(65) Prior Publication Data

US 2021/0363666 A1 Nov. 25, 2021

(30) Foreign Application Priority Data

Jul. 18, 2019 (CN) ..... 201910651423.2

(51) Int. Cl.

| | |
|---|---|
| ***D01F 8/06*** | (2006.01) |
| ***D01D 5/06*** | (2006.01) |
| ***D01D 7/00*** | (2006.01) |
| ***D01F 1/10*** | (2006.01) |

(52) U.S. Cl.
CPC ..... *D01F 8/06* (2013.01); *D01D 5/06* (2013.01); *D01D 7/00* (2013.01); *D01F 1/10* (2013.01); *D10B 2321/0211* (2013.01); *D10B 2401/063* (2013.01); *D10B 2501/041* (2013.01)

(58) Field of Classification Search
CPC .... D01F 8/06; D01F 1/10; D01F 6/46; D01D 5/06; D01D 7/00; D01D 1/02; D01D 5/12; A41D 19/01505; D10B 2101/12; D10B 2321/0211; D10B 2401/063; D10B 2501/041; F41H 1/02; F41H 5/0485; D02G 3/442
USPC ..... 428/373
See application file for complete search history.

(56) References Cited

U.S. PATENT DOCUMENTS

| | | | | |
|---|---|---|---|---|
| 2006/0115640 | A1* | 6/2006 | Yodh | B82Y 15/00 428/221 |
| 2011/0082262 | A1 | 4/2011 | Yeh et al. | |
| 2018/0363168 | A1 | 12/2018 | Zhang et al. | |

FOREIGN PATENT DOCUMENTS

| | | | | | |
|---|---|---|---|---|---|
| CN | 101109113 | A | | 1/2008 | |
| CN | 103387706 | A | | 11/2013 | |
| CN | 103643503 | A | | 3/2014 | |
| CN | 105734708 | A | | 7/2016 | |
| CN | 106521677 | A | | 3/2017 | |
| CN | 106555243 | A | | 4/2017 | |
| CN | 106555244 | A | * | 4/2017 | |
| CN | 107326462 | A | | 11/2017 | |
| CN | 107814995 | A | * | 3/2018 | C08J 3/24 |
| CN | 108277546 | A | | 7/2018 | |
| CN | 108559172 | A | * | 9/2018 | |
| CN | 109183243 | A | | 1/2019 | |
| CN | 109294089 | A | * | 2/2019 | C08J 3/226 |
| CN | 109438956 | A | * | 3/2019 | |
| CN | 109505020 | A | | 3/2019 | |
| CN | 106555245 | B | | 4/2019 | |
| CN | 109610029 | A | | 4/2019 | |
| CN | 109825891 | A | | 5/2019 | |
| CN | 109881281 | A | * | 6/2019 | |
| CN | 109913974 | A | | 6/2019 | |
| EP | 3508623 | A1 | | 7/2019 | |
| JP | 2003336130 | A | | 11/2003 | |
| JP | 200714851 | A | | 1/2007 | |
| JP | 2007277763 | A | | 10/2007 | |
| JP | 2018168488 | A | | 11/2018 | |
| RU | 2598090 | C1 | | 9/2016 | |
| WO | 2018060127 | A1 | | 4/2018 | |
| WO | 2019012130 | A1 | | 1/2019 | |

OTHER PUBLICATIONS

Machine Translation CN 106555244 A (Year: 2017).*
Machine Translation CN 109881281 A (Year: 2019).*
Mesh and Microns sizing Chart (Year: 2015).*

* cited by examiner

*Primary Examiner* — Lynda Salvatore
(74) *Attorney, Agent, or Firm* — Bayramoglu Law Offices LLC

(57) ABSTRACT

An ultra-high molecular weight polyethylene fiber with ultra-high cut resistance includes an ultra-high molecular weight polyethylene matrix and carbon fiber powder particles dispersed therein. The content of the carbon fiber powder particles is 0.25-10 wt %. A method for preparing the ultra-high molecular weight polyethylene fiber with the ultra-high cut resistance and a cut-resistant glove woven therefrom are further provided. The test proves that the glove woven from the ultra-high molecular weight polyethylene fiber with the ultra-high cut resistance is soft and comfortable, and does not have prickling sensation. According to the test of the Standard EN388-2003, the level of the cut-resistant grade ranges from 4 to 5.

12 Claims, No Drawings

ULTRA-HIGH MOLECULAR WEIGHT POLYETHYLENE FIBER WITH ULTRA-HIGH CUT RESISTANCE AND PREPARATION METHOD THEREOF

CROSS REFERENCE TO THE RELATED APPLICATIONS

This application is the national phase entry of International Application No. PCT/CN2019/105436, filed on Sep. 11, 2019, which is based upon and claims priority to Chinese Patent Application No. 201910651423.2, filed on Jul. 18, 2019, the entire contents of which are incorporated herein by reference.

TECHNICAL FIELD

The present disclosure relates to the technical field of polyethylene fibers, and more specifically relates to an ultra-high molecular weight polyethylene fiber with an ultra-high cut resistance and a preparation method thereof.

BACKGROUND

Ultra-high molecular weight polyethylene fiber is the fiber with the highest specific strength among the current industrialized fiber materials. It has excellent properties such as high strength, high modulus, abrasion resistance, and chemical resistance and is widely used in the fields of national defense and military, marine cables, and personal protection. With the continuation of military-civilian integration, the ultra-high molecular weight polyethylene fibers are increasingly available in the civilian market. The cut-resistant gloves, made of the ultra-high molecular weight polyethylene fibers, are gradually dominating the civilian market. Currently, the protective gloves made of commonly used 400D ultra-high molecular weight polyethylene fibers have a cut-resistant performance level 3 of the Standard EN388-2003 at most. This level is extremely unstable. Therefore, protective gloves are becoming increasingly unsuitable and lack the requirements of adequate protecting in actual working conditions where cutting hazards occur.

The common method to improve the cut-resistant performance of gloves is to blend and weave a material, such as glass fiber or steel wire, with ultra-high molecular weight polyethylene fiber. Although the gloves achieve an improved cut-resistant performance by this method, the gloves are uncomfortable due to the addition of these materials. On one hand, the steel wire is relatively hard and therefore, the gloves are uncomfortable. On the other hand, the glass fiber is relatively brittle and easily broken and exposed, therefore, the gloves are uncomfortable. Moreover, the glass fiber burrs are likely to cause secondary injuries on hands such as itching, stabbing, and scratching.

Currently, individuals in the industry have proposed that high molecular weight polyethylene nascent fibers can be produced by blending inorganic high-hardness materials with high molecular weight polyethylene powder to enhance the cut resistance of polyethylene fibers. This method has been confirmed to improve the cut resistance of polyethylene fibers, however, there are still two obvious disadvantages: (1) These inorganic high-hardness materials have relatively high hardness, which causes serious wear on preparation equipment. Components and parts of the equipment requires frequent replacement, which increases equipment investment and affects production efficiency. (2) Practical use shows that these high-hardness materials are prone to pierce the polyethylene fiber matrix, due to their low flexibility, and emerge from the polyethylene fibers, causing damage to the surface of the polyethylene fibers and thus cut resistance loses.

SUMMARY

1. Technical Problems to be Solved

In view of this, an ultra-high molecular weight polyethylene fiber with an ultra-high cut resistance, and a preparation method thereof, are provided to overcome the problems existing in the prior art. The ultra-high molecular weight polyethylene fiber with the ultra-high cut resistance can be woven into cut-resistant gloves, cut-resistant protective clothing, among others, thereby achieving high protective performance and well wearing comfort, avoiding abrasion and damage to production equipment, saving production costs, and prolonging the service life of the cut-resistant gloves or the cut-resistant protective clothing.

2. Technical Solutions

In order to achieve the above objectives, the main technical solutions provided by the present invention are as follows:

In one aspect of the present disclosure, an ultra-high molecular weight polyethylene fiber with an ultra-high cut resistance is provided, including an ultra-high molecular weight polyethylene matrix and carbon fiber powder particles dispersed therein, wherein the content of the carbon fiber powder particles is 0.25-10 wt %.

Typically, but not limited to, the content of the carbon fiber powder in the ultra-high molecular weight polyethylene matrix is 0.25 wt %, 0.5 wt %, 1 wt %, 1.2 wt %, 1.5 wt %, 2.0 wt %, 2.5 wt %, 3.0 wt %, 3.5 wt %, 4.0 wt %, 4.5 wt %, 5.0 wt %, 5.5 wt %, 6.0 wt %, 6.5 wt %, 7.0 wt %, 7.5% wt, 8.0 wt %, 8.5% wt, 9.0 wt %, 9.5 wt %, or 10.0 wt %.

The excessively high content of the carbon fiber powder particles leads to the low specific gravity of the polyethylene matrix, the produced polyethylene fiber is consequently less spinnable (easily broken during weaving). While the excessively low content of the carbon fiber powder particles cannot bring the improved cut-resistant performance needed.

The present disclosure further relates to a method for preparing an ultra-high molecular weight polyethylene fiber with an ultra-high cut resistance, including:

S1: mixing and emulsifying carbon fiber powder particles with a first solvent and a surfactant to obtain a carbon fiber powder emulsified material;

S2: dispersing the carbon fiber powder emulsified material and ultra-high molecular weight polyethylene powder having a molecular weight of 200,000 to 6,000,000 in a second solvent to obtain a mixture; and S3: blending and extruding the mixture through an extruder, cooling and molding in a coagulating bath to obtain a nascent fiber, extracting, drying and multi-stage hot stretching the nascent fiber to obtain the ultra-high molecular weight polyethylene fiber with the ultra-high cut resistance.

Typically, but not limited to, the molecular weight of the ultra-high molecular weight polyethylene is 200,000, 400,000, 600,000, 800,000, 1,000,000, 1,200,000, 1,400,000, 1,600,000, 1,800,000, 2,000,000, 2,200,000, 2,400,000, 2,600,000, 2,800,000, 3,000,000, 3,200,000, 3,400,000, 3,600,000, 3,800,000, 4,000,000, 4,200,000, 4,400,000, 4,600,000, 4,800,000, 5,000,000, 5,200,000, 5,400,000, 5,600,000, 5,800,000 or 6,000,000.

In a preferred embodiment of the present invention, the carbon fiber powder particle has a diameter of 0.1-10 μm and a length of 0.1-100 μm. Further, the carbon fiber powder particle is long rod-shaped with the length greater than the diameter. More preferably, the length is 20-60 μm. Typically, but not limited to, the length of the carbon fiber powder particle is 20-30 μm, 30-40 μm, 40-50 μm or 50-60 μm.

In a preferred embodiment of the present invention, the main component of the carbon fiber powder particles is microcrystalline graphite, wherein the carbon fiber powder particles may be obtained by crushing waste carbon fibers or cutting carbon fiber filaments.

In a preferred embodiment of the present invention, the carbon fiber powder particles are activated by performing a surface treatment in advance. As a result, the interfacial fusion and/or wettability of the carbon fiber powder particles with the solvent and ultra-high molecular weight polyethylene powder can be improved, thereby obtaining ultra-high cut-resistant polyethylene fiber with a uniform material distribution and a better and more stable performance.

In a preferred embodiment of the present invention, the method of the surface treatment is any one or a combination of at least two selections from a group consisting of: gas phase oxidation, liquid phase oxidation, catalytic oxidation, coupling agent coating, polymer coating, and plasma treatment. The above surface treatment allows the surface of the carbon fiber particle to have a weak polarity, prevents the agglomeration of the carbon fibers in the solvent, and improves the dispersion of the carbon fibers in the solvent. Thus, the carbon fiber particles can be more evenly dispersed in the ultra-high molecular weight polyethylene matrix and closely combined with the ultra-high molecular weight polyethylene matrix, thereby preventing the carbon fibers from peeling and improving the performance uniformity and validity of the ultra-high molecular weight polyethylene fiber with the ultra-high cut resistance.

In a preferred embodiment of the present invention, the mass ratio of the ultra-high molecular weight polyethylene, the carbon fiber powder, and the solvent is (10-40):(0.1-1):100. The mass of the solvent is equal to the sum of the masses of the first solvent and the second solvent.

According to the above mass ratio, a paste-like mixture is obtained, and the carbon fiber powder dispersed in the mixture is enough to have a relatively good cut resistance. It should be noted that in the present disclosure, the first solvent and the second solvent are different in the steps of using the solvents, which does not mean that the first solvent and the second solvent are different. In other words, the first solvent and the second solvent may be the same solvent or different solvents.

Preferably, each of the first solvent and the second solvent are created by selecting one or more from a group consisting of white oil, mineral oil, vegetable oil, paraffin oil, and decalin.

In a preferred embodiment of the present invention, the molecular weight of the ultra-high molecular polyethylene is 2,000,000-5,000,000.

The larger the molecular weight of the ultra-high molecular weight polyethylene, the higher the cut resistance and mechanical strength. However, the excessively high molecular weight results in extremely high viscosity, thus the extruding operation makes it hard to obtain the fiber filaments, and the equipment for the production is highly strict and readily consumable. After repeated tests, the cut-resistant polyethylene fiber filament obtained with a molecular weight of 2,000,000-5,000,000 has the best performance in all aspects and is conducive to decreasing equipment abrasion.

In a preferred embodiment of the present invention, the extruder is a twin-screw extruder, and the temperature of each zone of the twin-screw extruder is controlled at 100-300° C.

In a preferred embodiment of the present invention, the surfactant is an alkylolamide (Ninol 6502), which is a mild nonionic surfactant obtained by a condensation reaction of coconut oil or palm kernel oil and diethanolamine. Alternatively, the surfactant is an alkylolamide phosphate ester. These surfactants have the functions of solubilization, emulsification and antistatic conditioning do not cause skin irritation, which are often used as detergents, clothing care agents, among others. Obviously, the surfactant is not limited to those listed above, but may be any surfactant capable of emulsifying and increasing the dispersion degree of the carbon fiber powder in the solvent, such as stearic acid, sodium dodecylbenzenesulfonate, alkyl glucoside (APG), triethanolamine, fatty acid glyceride, sorbitan fatty acid esters (Span), polysorbate (Tween), sodium dioctyl succinate sulfonate (Aloseau-OT), sodium dodecylbenzene sulfonate, sodium glycocholic acid, and others.

The present disclosure relates to an ultra-high molecular weight polyethylene fiber with an ultra-high cut resistance, which is obtained by using the preparation method described in any one of the above embodiments.

The present disclosure further relates to an ultra-high cut-resistant glove or clothing, which includes a knitted fabric woven from the ultra-high molecular weight polyethylene fiber with the ultra-high cut resistance in any one of the above embodiments, or prepared by the preparation methods described in any one of the above embodiments.

Carbon fiber (CF), as a microcrystalline graphite material, is a new fiber material having high strength and high modulus with a carbon content of equal to or more than 95%. Carbon fiber is soft outside and hard inside, with a weight lighter than metal aluminum, but a strength higher than steel, and it has the characteristics of corrosion resistance and high modulus. Carbon fiber has the inherent characteristics of carbon materials and also has the softness and processability of textile fibers, which is a new generation of reinforcing fibers. The main features of carbon fiber are as follows: (1) having softness and processability of textile fibers; (2) having tensile strength of more than 3500 MPa; (3) having tensile elastic modulus ranging from 230 GPa to 430 GPa.

Plasma surface treatment: a plasma surface treatment device is used in a low-temperature plasma that is in a non-thermodynamic equilibrium state. Electrons have higher energy and can break the chemical bonds of molecules on the surface of the material and improve the chemical reaction activity of particles (greater than thermal plasma), while the temperature of the neutral particles is close to room temperature. These advantages provide suitable conditions for the surface modification of thermosensitive polymers. Through the low-temperature plasma surface treatment, various physical and chemical changes occur on the material surface. The surface is cleaned and the hydrocarbon-based contaminants, such as grease and auxiliary additives, are removed. Or, the surface is roughened due to etching that forms a dense cross-linked layer, or is treated with oxygen-containing polar groups (such as hydroxyl and carboxyl). These groups have the effect of promoting the adhesion of various coating materials which are optimized during adhesive and paint applications.

3. Advantages

The advantages of the present invention are as follows.

(1) In the present invention, carbon fiber powder is used as an additive to be dispersed in an ultra-high molecular weight polyethylene fiber matrix material, thereby obtaining an ultra-high molecular weight polyethylene fiber with an ultra-high cut resistance. Compared with the prior art, where the gloves are prepared by blending and weaving materials such as glass fiber and steel wire with ultra-high molecular weight polyethylene fiber, the glove or semi-finished glove woven from the ultra-high molecular weight polyethylene fiber with the ultra-high cut resistance provided in the present invention has better wearing comfort, such as feeling softer, having no problems such as burrs, itching, scratching, and others, and easy to wear and so on.

(2) Compared with other inorganic high hardness materials, such as boron nitride and tungsten carbide as reinforcing additives, the carbon fiber powder used in the present invention will not weaken the cut resistance of the ultra-high molecular weight polyethylene nascent fiber, and may decrease wear and tear to the equipment, reduce equipment and production costs, and have no negative impact on production efficiency due to the carbon fiber's relatively low hardness and relatively high toughness when the carbon fiber powder is blended and extruded with the ultra-high molecular weight polyethylene powder to produce the ultra-high molecular weight polyethylene nascent fiber. In addition, the carbon fiber powder has improved strength and softness, so that the surface of the ultra-high molecular weight polyethylene fiber matrix is difficult to pierce and cause fiber damage. Therefore, the carbon fiber powder can be retained in the polyethylene fiber matrix for a longer period of time, allowing the high-cut-resistant polyethylene fiber to have a longer-lasting cut resistance.

(3) Further, in the present invention, when preparing the ultra-high molecular weight polyethylene fiber with the ultra-high cut resistance, the carbon fiber powder is first subjected to a surface activation treatment in order to improve the dispersion degree of the carbon fiber powder and prevent agglomeration in the solvent. Subsequently, the carbon fiber powder is first made into an additive emulsified material, and then dispersed in a solvent together with the ultra-high molecular weight polyethylene powder to obtain a mixture. A screw extruder is used to blend and extrude the mixture to obtain a nascent fiber, so the carbon fiber powder can be uniformly and extremely-stable when fused into the ultra-high molecular weight polyethylene fiber matrix and combined with ultra-high molecular weight polyethylene fiber to form a stable solid, so that the ultra-high molecular weight polyethylene fiber functions as a solid dispersant for the carbon fiber powder, and the ultra-high molecular weight polyethylene fiber with better cut resistance, higher uniformity and better quality is obtained.

In summary, the ultra-high-molecular-weight polyethylene fiber with the ultra-high cut resistance provided by the present invention, greatly improves the cut-resistant performance of polyethylene fibers, and the cut-resistance level of the knitted gloves and other fabrics can reach and keep a stable level 5 of the Standard EN388-2003. More importantly, the ultra-high molecular weight polyethylene fiber with the ultra-high cut resistance, prepared according to the present invention, does not need to be blended with steel wire, glass fiber and other materials for reinforcement. The obtained protective glove is soft, light, sensitive, and not prone to fatigue when worn for a long time, achieving both ultra-high cut resistance and wearing comfort.

DETAILED DESCRIPTION OF THE EMBODIMENTS

In order to thoroughly illustrate the present invention to facilitate understanding, the present invention is described in detail below through specific embodiments.

The overall conception of the present invention is as follows: A certain amount of carbon fiber powder is used as one of the raw materials for preparing an ultra-high molecular weight polyethylene nascent fiber. The carbon fiber powder particles are uniformly and stably fused into the ultra-high molecular weight polyethylene fiber matrix and combined with the ultra-high molecular weight polyethylene fiber to form a stable solid to obtain an ultra-high molecular weight polyethylene fiber with ultra-high cut resistance. Compared with other high-hardness inorganic reinforcing materials, carbon fiber has an incomparable characteristic, i.e. "being soft outside and hard inside". Carbon fiber can replace other high-hardness inorganic reinforcing materials to allow ultra-high molecular weight polyethylene fibers to have high cut resistance. Moreover, carbon fiber has significant advantages in reducing wear on equipment and preventing the piercing of the ultra-high molecular weight polyethylene fiber matrix during repeated use, which weakens the cut resistance.

Preferably, the specific preparation method of the present invention can be performed according to the following steps:

(1) Preparation of carbon fiber powder:

The particles of the carbon fiber powder are preferably rod-shaped with a diameter of 0.1-10 μm and a length of 0.1-100 μm; and more preferably a length of 20-60 μm.

The main component of the carbon fiber powder is microcrystalline graphite, which may be obtained by crushing and sieving waste carbon fibers; or may be made by cutting carbon fiber filaments.

(2) Surface treatment of carbon fiber powder:

The main function of the surface treatment is to activate the particle surface of the carbon fiber powder. The available methods include: gas phase oxidation, liquid phase oxidation, catalytic oxidation, coupling agent coating, polymer coating, and plasma treatment.

After the carbon fiber particles are activated, the surface of the carbon fiber has a weak polarity, which can improve the dispersion of the carbon fiber particles in the solvent, prevent the agglomeration of the carbon fiber powder, and thus further improve the dispersion uniformity, the interfacial fusion property, and/or the wettability of the carbon fiber particles in the ultra-high molecular weight polyethylene matrix, thereby obtaining an ultra-high cut-resistant polyethylene fiber with better performance.

(3) Preparation of carbon fiber powder emulsified material

The treated carbon fiber powder and the surfactant are added to a solvent to perform a high-shear emulsification to obtain the carbon fiber powder emulsified material. The solvent is one or more selected from a group consisting of white oil, mineral oil, vegetable oil, paraffin oil and decalin.

(4) Preparation of the mixture: an ultra-high molecular weight polyethylene powder with the molecular weight of 200,000-6,000,000 (preferably 400,000-800,000) and the carbon fiber powder emulsified material are added to the remaining solvent to achieve the mixture.

The mass ratio of the ultra-high molecular weight polyethylene, the carbon fiber powder emulsified material, and the solvent is (10-40):(0.1-1):100.

The solvent is one or more selected from the group consisting of white oil, mineral oil, vegetable oil, paraffin oil, and decalin.

(5) Preparation of cut-resistant polyethylene fiber

The mixture is extruded through a twin-screw extruder, and a nascent fiber is obtained by cooling and molding in a coagulating bath. The temperature of each zone of the twin-screw extruder is controlled between 100° C. and 300° C. The nascent fiber is extracted, dried, and subjected to multi-stage hot stretching to form the ultra-high molecular weight polyethylene fiber with the ultra-high cut resistance.

The advantages of the solution of the present invention are further described below in combination with specific embodiments.

Embodiment 1

This embodiment provides a method for preparing an ultra-high molecular weight polyethylene fiber with an ultra-high cut resistance, including the following steps.

(1) 750 g of carbon fiber powder with a length of 10-20 μm is taken and subjected to a surface treatment with plasma for 1 hour.

(2) 100 kg of white oil is weighed, where 5 kg of the 100 kg white oil is taken out to be added with the treated carbon fiber powder and 5 ml of surfactant (disodium monolauryl sulfosuccinate) for a high-shear emulsification with the shearing speed of 2800 r/min for 30 min to obtain a carbon fiber emulsified material.

(3) 15 kg of ultra-high molecular weight polyethylene powder with the molecular weight of 2,000,000 and the average particle size of 100 μm and the carbon fiber emulsified material are added to the remaining 95 kg of the white oil for mixing evenly for 1 hour to obtain a mixture.

(4) The mixture is blended and extruded through a twin-screw extruder, and is cooled and molded in a coagulation bath to obtain a nascent fibre. The obtained nascent fiber is extracted, dried, and subjected to multi-stage hot stretching to obtain the ultra-high molecular weight polyethylene fiber with the ultra-cut resistance, wherein the concentration of the carbon fiber dispersed in the ultra-high molecular weight polyethylene is 5%.

The cut-resistant gloves made of the above fiber are soft and comfortable, and do not have prickling sensation. According to the test of the Standard EN388-2003, the cut-resistant grade is level 5.

Embodiment 2

This embodiment provides a method for preparing an ultra-high molecular weight polyethylene fiber with an ultra-high cut resistance, including the following steps.

(1) 800 g of carbon fiber powder with a length of 20-30 μm is taken and subjected to a surface treatment with plasma for 1 hour.

(2) 100 kg of white oil is weighed, where 5 kg of the 100 kg white oil is taken out to be added with the treated carbon fiber powder and 15 ml of surfactant (disodium cocamido mea-sulfosuccinate (DMSS)) for a high-shear emulsification with the shearing speed of 2800 r/min for 30 min to obtain a carbon fiber emulsified material.

(3) 20 kg of ultra-high molecular weight polyethylene powder with the molecular weight of 3,000,000 and the average particle size of 100 μm and the carbon fiber emulsified material are added to the remaining 95 kg of the white oil for mixing evenly for 1 hour to obtain a mixture.

(4) The mixture is blended and extruded through a twin-screw extruder, and is cooled and molded in a coagulation bath to obtain a nascent fibre. The obtained nascent fiber is extracted, dried, and subjected to multi-stage hot stretching to obtain the ultra-high molecular weight polyethylene fiber with the ultra-cut resistance, wherein the concentration of the carbon fiber dispersed in the ultra-high molecular weight polyethylene is 4%.

The cut-resistant gloves made of the above fiber are soft and comfortable, and do not cause prickling sensation. According to the test of the Standard EN388-2003, the cut-resistant grade is level 5.

Embodiment 3

This embodiment provides a method for preparing an ultra-high molecular weight polyethylene fiber with an ultra-high cut resistance, including the following steps.

(1) 1000 g of carbon fiber powder with a length of 30-60 μm is taken and subjected to a surface treatment with plasma for 1 hour.

(2) 100 kg of white oil is weighed, where 5 kg of the 100 kg white oil is taken out to be added with the treated carbon fiber powder and 10 ml of surfactant (lauryl alcohol phosphate acid ester (MAP)) for a high-shear emulsification with the shearing speed of 2800 r/min for 30 min to obtain a carbon fiber emulsified material.

(3) 10 kg of ultra-high molecular weight polyethylene powder with the molecular weight of 2,600,000 and the average particle size of 100 μm and the carbon fiber emulsified material are added to the remaining 95 kg of the white oil with for mixing evenly for 1 hour to obtain a mixture.

(4) The mixture is blended and extruded through a twin-screw extruder, and is cooled and molded in a coagulation bath to obtain a nascent fibre. The obtained nascent fiber is extracted, dried, and subjected to multi-stage hot stretching to obtain the ultra-high molecular weight polyethylene fiber with the ultra-cut resistance, wherein the concentration of the carbon fiber dispersed in the ultra-high molecular weight polyethylene is 10%.

The cut-resistant gloves made of the above fiber are soft and comfortable, and do not have prickling sensation. According to the test of the Standard EN388-2003, the cut-resistant grade is level 5.

Embodiment 4

This embodiment provides a method for preparing an ultra-high molecular weight polyethylene fiber with an ultra-high cut resistance, including the following steps.

(1) 750 g of carbon fiber powder with a length of 20-30 μm is taken and subjected to a surface treatment with plasma for 1 hour.

(2) 100 kg of white oil is weighed, where 5 kg of the 100 kg white oil is taken out to be added with the treated carbon fiber powder and 10 ml of surfactant (potassium mono lauryl phosphate (MAPK)) for a high-shear emulsification with the shearing speed of 2800 r/min for 30 min to obtain a carbon fiber emulsified material.

(3) 20 kg of ultra-high molecular weight polyethylene powder with the molecular weight of 3,600,000 and the average particle size of 100 μm and the carbon fiber emulsified material are added to the remaining 95 kg of the white oil for mixing evenly for 1 hour to obtain a mixture.

(4) The mixture is blended and extruded through a twin-screw extruder, and is cooled and molded in a coagulation bath to obtain a nascent fibre. The obtained nascent fiber is extracted, dried, and subjected to multi-stage hot stretching to obtain the ultra-high molecular weight polyethylene fiber with the ultra-cut resistance, wherein the concentration of the carbon fiber dispersed in the ultra-high molecular weight polyethylene is 3.75%.

The cut-resistant gloves made of the above fiber are soft and comfortable, and do not have prickling sensation. According to the test of the Standard EN388-2003, the cut-resistant grade is level 5.

Embodiment 5

This embodiment provides a method for preparing an ultra-high molecular weight polyethylene fiber with an ultra-high cut resistance, including the following steps.

(1) 600 g of carbon fiber powder with a length of 40-60 μm is taken and subjected to a surface treatment with plasma for 1 hour.

(2) 100 kg of vegetable oil is weighed, where 5 kg of the 100 kg vegetable oil is taken out to be added with the treated carbon fiber powder and 10 ml of surfactant (potassiam polyoxyethylene laurylether phosphate (MAEPK)) for a high-shear emulsification with the shearing speed of 2800 r/min for 30 min to obtain a carbon fiber emulsified material.

(3) 30 kg of ultra-high molecular weight polyethylene powder with the molecular weight of 400,000 and the average particle size of 100 μm and the carbon fiber emulsified material are added to the remaining 95 kg of the vegetable oil for mixing evenly for 1 hour to obtain a mixture.

(4) The mixture is blended and extruded through a twin-screw extruder, and is cooled and molded in a coagulation bath to obtain a nascent fibre. The obtained nascent fiber is extracted, dried, and subjected to multi-stage hot stretching to obtain the ultra-high molecular weight polyethylene fiber with the ultra-cut resistance, wherein the concentration of the carbon fiber dispersed in the ultra-high molecular weight polyethylene is 2%.

The cut-resistant gloves made of the above fiber are soft and comfortable, and do not have prickling sensation. According to the test of the Standard EN388-2003, the cut-resistant grade is level 4.

Embodiment 6

This embodiment is based on embodiment 1, where the carbon fiber is not performed with any surface treatment, and is agglomerated in the emulsified material. Other conditions and processing procedures are the same as embodiment 1. The ultra-high molecular weight polyethylene fiber with the ultra-high cut resistance is obtained, where the carbon fiber is dispersed in the ultra-high molecular weight polyethylene at a concentration of 5%. The carbon fiber without surface activation treatment is prone to agglomeration, and the obtained fiber filament is less spinnable, and the cut resistance of gloves woven from the fiber is also unstable.

Comparative Example 1

The carbon fiber in embodiment 1 is replaced with 750 g of boron nitride having a length of 10-20 μm. Other conditions and processing procedures are the same as embodiment 1. The ultra-high molecular weight polyethylene fiber with the ultra-high cut resistance is obtained, where the boron nitride is dispersed in the ultra-high molecular weight polyethylene at a concentration of 5%. The obtained fiber filament is less spinnable. The cut resistance of the gloves woven from the fiber is rapidly weakened and the gloves become burred, hard and uncomfortable with the continuous consumption of the gloves.

Comparative Example 2

The carbon fiber in embodiment 1 is replaced with 750 g of tungsten carbide having a length of 10-20 μm. Other conditions and processing procedures are the same as embodiment 1. The ultra-high molecular weight polyethylene fiber with the ultra-high cut resistance is obtained, where the tungsten carbide is dispersed in the ultra-high molecular weight polyethylene at a concentration of 5%. The obtained fiber filament less spinnable. The cut resistance of the gloves woven from the fiber is rapidly weakened and the gloves become burred, hard and uncomfortable with the continuous consumption of the gloves.

The ultra-high molecular weight polyethylene fibers with the ultra-high cut resistance obtained in embodiments 1-6 and comparative examples 1-2 are woven into 13-needle protective gloves, respectively. After the gloves are worn and used by the workers of the same position and performing the same operation for 1 day (1d) and 20 days (20d), the performance of the gloves is tested respectively. The test results are shown in the following table.

| | Indicator | | | |
|---|---|---|---|---|
| Group | EN388-2003 test data (1 d) | EN388-2003 grade (1 d) | EN388-2003 test data (20 d) | Appearance of gloves after 20 d of use |
| Embodiment 1 | 20.7 | 5 | 19.5 | Glove surface is soft and smooth |
| Embodiment 2 | 22.1 | 5 | 20.6 | Glove surface is soft and smooth |
| Embodiment 3 | 21.6 | 5 | 20.3 | Glove surface is soft and smooth |
| Embodiment 4 | 22.8 | 5 | 21.8 | Glove surface is soft and smooth |
| Embodiment 5 | 12.6 | 4 | 12.2 | Glove surface is soft and smooth |
| Embodiment 6 | 9.8-20.2 | 3-5 | 9.1-15.7 | Glove surface is soft and smooth |
| Comparative example 1 | 13.0 | 4 | 4.8 | Glove surface is rough and hard |
| Comparative example 2 | 20.5 | 5 | 7.6 | Glove surface is rough and hard |

The test results of the above embodiments show that the cut-resistant grade of the fabrics woven from the ultra-high molecular weight polyethylene fiber with the ultra-high cut resistance obtained according to the present invention can indeed reach the level 4-5 of the Standard EN388-2003. More importantly, the ultra-high molecular weight polyethylene fiber with the ultra-high cut resistance obtained according to the present invention does not need to be blended with steel wire, glass fiber and other materials for reinforcement. The obtained protective gloves are soft, light, sensitive, and comfortable, and are not easy to fatigue after using for a long time.

In addition, compared with embodiments 1-5, embodiment 6 shows an unstable test result, which is mainly due to the uneven distribution of the carbon fiber in the ultra-high molecular polyethylene matrix.

Compared with embodiments 1-6, the high cut-resistant gloves of comparative examples 1-2 have a cut-resistant value and grade equivalent to those of embodiments 1-6 of the present invention when used for about 1 day. However, after 20 days of use, the cut resistance of the gloves of comparative examples 1-2 drop sharply, and the gloves become burred, hard and uncomfortable. In embodiment 6, three different positions are taken for test, and a range value is obtained. In the gloves of comparative examples 1-2, mainly due to repeated bending and twisting during 20 days of use, the inflexible high-hardness inorganic reinforcing material directly pierces the polyethylene matrix, resulting in damage to the surface of the polyethylene matrix and generating burrs. Meanwhile, the partial release of the inorganic reinforcing material further weakens the cut resistance performance. On the contrary, the carbon fiber reinforced polyethylene glove of the present invention exhibits exceptional durability, and after repeated use, the cut resistance is almost equivalent to that of the product just made. Moreover, the carbon fiber reinforced polyethylene glove is soft and smooth, and the wearing experience is good.

This shows that, because the inorganic high-hardness reinforcing material used in comparative example 1 has high hardness but poor softness, it easily pierces the surface of the ultra-high molecular weight polyethylene fiber matrix, which causes an abrasion and a loss of the high-hardness reinforcing material, resulting in a rapid decline in cut resistance. In addition, the cut-resistant glove prepared by using the carbon fiber as a cut-resistant reinforcing material additive in the present invention has a cut-resistant performance comparable to the gloves added with inorganic high-hardness materials such as boron nitride and tungsten carbide.

In addition, according to the applicant's experimental preparation research in the past six months, it is found that when the inorganic high-hardness additive materials in comparative examples 1-2 are used to enhance the cut resistance of high molecular weight polyethylene fibers, the equipment such as the screws of the extruder is seriously and obviously damaged, the equipment depreciates very quickly. However, in the present invention, the carbon fiber is used to replace these inorganic high-hardness reinforcing materials, and the abrasion degree of the equipment is almost equal to that for producing conventional ultra-high molecular weight polyethylene fibers.

What is claimed is:

1. A method for preparing an ultra-high molecular weight polyethylene fiber with an ultra-high cut resistance, comprising:

S1: subjecting carbon fiber powder particles to surface treatment to activate surfaces of the carbon fiber powder particles to produce surface treated carbon fiber powder particles, wherein a method of the surface treatment comprises plasma treatment;

S2: mixing and dispersing the surface treated carbon fiber powder particles with a first solvent and a surfactant to obtain a carbon fiber powder dispersed material, wherein the surfactant is at least one selected from the group consisting of alkylolamide, alkylolamide phosphate ester, stearic acid, alkyl glucoside, triethanolamine, polysorbate, and sodium glycocholic acid;

S3: further dispersing the carbon fiber powder dispersed material with an ultra-high molecular weight polyethylene powder having a molecular weight of 200,000 to 6,000,000 in a second solvent to obtain a mixture, wherein a ratio of a mass of the ultra-high molecular weight polyethylene powder to a mass of the carbon fiber powder particles and to a mass of the first solvent and the second solvent is (10-40):(0.1-1):100; and S4: blending and extruding the mixture through an extruder to obtain an extruded mixture, cooling and molding the extruded mixture in a coagulating bath to obtain a nascent fiber, extracting, drying and multi-stage hot stretching the nascent fiber to obtain the ultra-high molecular weight polyethylene fiber with the ultra-high cut resistance, wherein the ultra-high molecular weight polyethylene fiber with the ultra-high cut resistance comprises an ultra-high molecular weight polyethylene matrix and carbon fiber powder particles dispersed in the ultra-high molecular weight polyethylene matrix, wherein a content of the carbon fiber powder particles is 0.25-10 wt %.

2. The method of claim 1, wherein, each carbon fiber powder particle of the carbon fiber powder particles has a diameter of 0.1-10 μm and a length of 0.1-100 μm; and each carbon fiber powder particle is long rod-shaped with the length greater than the diameter.

3. The method of claim 2, wherein, a component of the carbon fiber powder particles is microcrystalline graphite, and the carbon fiber powder particles are obtained by crushing waste carbon fibers.

4. The method of claim 1, wherein, the molecular weight of the ultra-high molecular weight polyethylene powder is 2,000,000-5,000,000.

5. The method of claim 1, wherein, the extruder is a twin-screw extruder, and a temperature of each zone of the twin-screw extruder is controlled at 100-300° C.

6. An ultra-high cut-resistant glove, comprising a knitted fabric woven from the ultra-high molecular weight polyethylene fiber with the ultra-high cut resistance produced from claim 1.

7. An ultra-high cut-resistant clothing, comprising a knitted fabric woven from the ultra-high molecular weight polyethylene fiber with the ultra-high cut resistance produced by the method of claim 1.

8. An ultra-high cut-resistant clothing, comprising a knitted fabric woven from the ultra-high molecular weight polyethylene fiber with the ultra-high cut resistance produced by the method of claim 1, wherein the cut-resistant grade is level 5 after being worn and used for 1 day by a user according to the test of the Standard EN388-2003.

9. An ultra-high cut-resistant clothing, comprising a knitted fabric woven from the ultra-high molecular weight polyethylene fiber with the ultra-high cut resistance produced by the method of claim 1, wherein the cut-resistant grade is level 5 after being worn and used for 20 days by a user according to the test of the Standard EN388-2003.

10. The method of claim 1, wherein each carbon fiber powder particle of the carbon fiber powder particles has a tensile strength of more than 3500 MPa and a tensile elastic modulus of 230 GPa to 430 GPa.

11. The method of claim 1, wherein each carbon fiber powder particle of the carbon fiber powder particles has a length of 20-60 μm.

12. The method of claim 1, wherein the method of the surface treatment further comprises gas phase oxidation, liquid phase oxidation, and/or catalytic oxidation.

* * * * *